United States Patent [19]

Small

[11] Patent Number: 4,669,730

[45] Date of Patent: Jun. 2, 1987

[54] AUTOMATED SWEEPSTAKES-TYPE GAME

[76] Inventor: Maynard E. Small, 105 Ward Pkwy., Apt. 507, Kansas City, Mo. 64112

[21] Appl. No.: 668,011

[22] Filed: Nov. 5, 1984

[51] Int. Cl.[4] ..... A63F 9/00

[52] U.S. Cl. ..... 273/138 A; 273/1 E

[58] Field of Search ..... 273/1 E, 138 A, DIG. 28; 364/410–412

[56] References Cited

U.S. PATENT DOCUMENTS

| | | | |
|---|---|---|---|
| 3,124,674 | 3/1964 | Edwards et al. . | |
| 3,327,292 | 6/1967 | Eriksson et al. . | |
| 3,770,269 | 11/1973 | Elder | 273/138 A |
| 3,786,234 | 1/1974 | Trent et al. . | |
| 3,787,660 | 1/1974 | Meyers et al. . | |
| 3,909,002 | 9/1975 | Levy . | |
| 3,982,102 | 9/1976 | Cidade . | |
| 4,031,376 | 6/1977 | Corkin, Jr. . | |
| 4,072,930 | 2/1978 | Lucero et al. . | |
| 4,108,361 | 8/1978 | Krause . | |
| 4,322,612 | 3/1982 | Lange . | |
| 4,323,770 | 4/1982 | Dieulot et al. . | |
| 4,339,798 | 7/1982 | Hedges et al. | 273/138 A |
| 4,373,723 | 2/1983 | Brown et al. | 273/138 A |
| 4,467,424 | 8/1984 | Hedges et al. . | |

OTHER PUBLICATIONS

Union National Bank "Express Cash" Sweepstakes, May 1982.

Commerce Bank "Connection 24 Sweepstakes" Pamphlet publ. date unknown, but at least by Aug. 1983.

Supermarket News, "ATMs for Retailers an "Open Question", Jul. 23, 1984.

Sweepstakes-Type Game Conducted by Bank in Texas during 1983.

Centerre Bank "Big Dollar Giveaway" pamphlet, published Oct. 1984.

Cracker National Bank promotion, data unknown.

*Primary Examiner*—Leo P. Picard

*Assistant Examiner*—MaryAnn Stoll Lastova

*Attorney, Agent, or Firm*—Litman, Day & McMahon

[57] ABSTRACT

An apparatus and method for playing a sweepstakes-type game wherein a player inserts an identification card into an automated remote computer terminal and accesses an account at a subject financial institution. The user identifier provides access to the financial account, and user indicia is compared to a game indicia. A sweepstakes processor compares the user and game indicia to determine whether a selected winning correlation is present between the game indicia and user indicia. The sweepstakes processor communicates with the remote computer terminal to notify the user of the presence or absence of a selected winning correlation, and upon the presence of the winning correlation, the user is notified of the prize awarded to him. The game apparatus is adapted to be used with a network of data processing machines and a transmission facilities device, which provides data processing communication among the data processing machines. A plurality of the remote computer terminals communicate with the network of data processing machines such that a user can access the sweepstakes data processor from any of the plurality of remote computer terminals.

17 Claims, 7 Drawing Figures

AUTOMATED SWEEPSTAKES-TYPE GAME

BACKGROUND OF THE INVENTION

This invention relates to a game apparatus and, more particularly, to game devices which require the use of a remote computer terminal and data processor for matching certain user indicia with corresponding game indicia.

Sweepstakes-type games are well known, and typically involve the selection of a series of numbers by a player and the comparison of same to a random preselected number determined by the sweepstakes operator. If the numbers match, the player or user is typically awarded a prize, either as pre-determined by the operator or through an alternative random selection process. Previous sweepstakestype games have required active participation by the user.

In recent decades, significant advancements have been made in the development of computer technology. Such elements have influenced the operation of financial institutions, such as banks and savings and loans associations. It is now commonplace for a financial institution to issue its customers a debit card with a magnetically encoded stripe on the back thereof. The debit card is designed for insertion into a remote computer terminal, such as an automated teller machine (ATM) or point-of-sale (POS) terminal. The remote terminal is in electronic communication with a data processor associated with the financial institution. Upon entry of proper user identifiers, such as a personal identification number (PIN), the user has electronic access to his or her account so that various transactions can be undertaken.

One significant development in the computer field enables a network of participating financial institutions to communicate among themselves such that the customer of one institution can use his or her debit card to execute certain transactions at another participating institution's automated teller machine. These networks are typically known as electronic funds transfer systems. To accomplish the routing of a particular customer's transaction to his account with his financial institution, sophisticated data processing machines known as transmission facilities devices, or switches, are utilized. The switch is comparable to a traffic controller in that it routes a specific transaction to its appropriate destination. It is envisioned that with proper computer hardware and software, a user will be able to access his financial account from practically anywhere in the world.

The advantage of the financial institution is that the amount of paperwork is drastically reduced in that no checks or the like are involved. In the case of the POS terminal, the user's financial account is immediately debited in the amount of the user's purchase. Such a system is advantageous to the merchant because the funds are immediately transferred to the merchant's account from the user's account; thus, there is no float time or chance of non-collection of a check. Again, the financial institution saves time and money through the reduction of its paper processing.

Notwithstanding the convenience to the user, the use of debit cards at ATMs and POS terminals has not been as high as the financial institutions require to achieve substantial economic benefit from the machines. Thus, there exists a need for a manner in which to promote the use of the machines, both for the benefit of a financial institution and the associated merchants. Preferably, the promotional scheme should promote the use of the debit cards in addition to promoting the goods and services of the merchants by rewarding the user of the ATM or POS terminal. There further exists a need for a device to promote the debit card use on a broad geographic basis without resorting to active involvement of the user or employees of the financial institution.

OBJECTS OF THE INVENTION

The principal objects of the present invention are: to provide a game apparatus for encouraging the use of remote financial institution computer terminals; to provide such a game apparatus which utilizes a sweepstakes-type game scheme; to provide such a game apparatus which utilizes a sweepstakes game computer in conjunction with a financial institution data processor and a remote computer terminal; to provide such a game apparatus which can be used in conjunction with a network of financial institution data processors having electronic communication means thereamong; to provide such a game apparatus having means to identify a user of a remote computer terminal and assign a user-specific indicia thereto for matching to a randomly selected game indicia to determine whether the user wins a prize; to provide such a game apparatus wherein the user indicia is the user's account number with his or her financial institution; to provide such a game apparatus which is relatively simple to use, economical to manufacture, requires relatively low labor input, minimal computer tiem, and user active participation and is particularly adapted for the proposed usage thereof.

Other objects and advantages of this invention will become apparent from the following description taken in conjunction with the accompanying drawings wherein are set forth, by way of illustration and example, certain embodiments of this invention.

SUMMARY OF THE INVENTION

A game apparatus for participation of a user in a sweepstakes-type game promotes the use of a remote computer terminal adapted to be in electronic communication with a financial institution. A user interacts with an interface device, such as a remote computer terminal, and more particularly an automated teller machine (ATM) or point-of-sale (POS) terminal. Preferably, magnetically encoded debit card is inserted into the ATM or POS terminal and the user is required to identify his account through the use of a personal identification number (PIN).

Upon validation of the user's access to the financial institution account, the account number is relayed to a sweepstakes processor. The sweepstakes processor has means for generating a random game indicia, e.g. a game number. The processor is further adapted to compare the account number and the game number and determine whether the two numbers match.

The present invention is designed to be used in conjunction with a network of financial institutions having interconnected data processing facilities. Typically, each separate financial institution has a plurality of ATM and/or POS terminals. In recent years network systems have been developed to allow electronic communications among the various ATMs and POS terminals and the financial institutions such that a user of any of the ATMs can access his personal financial account. A transmission facilities device, commonly known as a switch, is a sophisticated computer facility having the means to route a particular transaction from any of the ATMs or POS terminals to the appropriate financial institution and then relay information back to the ATM or POS terminal. In this way, a user can access his financial account in one city even trough the user is in a city located many hundreds or thousands of miles away, so long as the ATM or POS terminal and the individual user's financial institution are on the network.

In order to limit fraudulent access, in addition to the magnetically encoded debit card, each user is assigned a personal identification number, i.e. PIN, which is designed to be kept secret. Typically, only a central holding company has access to the PINs, although the PINs are recorded in each financial institution's computer data banks. Appropriate security limits are placed on access to these computer data banks.

A sophisticated communications network such as the one described in an expensive endeavor. In order to justify the expense, it is vital that the financial institutions customers utilize the system. The financial institutions benefit from the use of the system in that the transactions are essentially paperless and are not labor intensive, resulting in cost savings sufficient to justify the capital outlay. In addition, some financial institutions charge a nominal fee to the user for each transaction using the debit card, in much the same way that check fees are imposed.

It is the purpose of the present inention to stimulate use of the ATMs and POS terminals by providing a sweepstakes-type game which utilizes a network apparatus. Upon insertion of the debit card to an ATM or POS terminal, the user is required to enter the PIN, which validates the user's access to the particular financial institution account. The sweepstakes processor reads the account number or other selected user indicia and compares the accound number to a computer-generated prize number. The prize number may be randomly generated instantaneously with the reading of the account number, or one or more winning account numbers can be pre-selected, but preferably on a random basis. In either case, the prize number is compared to the account number and a determination is made as to whether a winning correlation exists between the two numbers. Preferably, an identical match is required between the prize number and account number. Typically, the account numbers are about ten digits in length; thus, a great deal of flexibility is available in terms of the required winning correlation. It is possible that a particular prize could be awarded for matching, for example, five numbers out of ten numbers, whereas a different selected prize could be fiven for an identical match.

If the account number does not match the prize number, this information is relayed back to the ATM or POS terminal (through the switch if present) and preferably, the user is so notified on a transaction receipt, which is delivered to the user upon completion of the other financial transactions.

If a winning correlation exists, the sweepstakes computer is programmed to determine the prize to be awarded the user. As with the generation of the prize number, it is possible to randomly select a prize each time a winning correlation is encountered. Alternatively, if the winning numbers are pre-selected, it is possible to assign a prize to that number upon generation of same. As a third alternative, the prizes can be awarded in a pre-selected order, thereby ensuring that, for example, the "grand" prize is awarded at an appropriate time during the sweepstakes. Whichever alternative is selected, it is essential to program the sweepstakes processor to include a sweepstakes account, which keeps track of each prize so that only a predetermined number of prizes are awarded. The sweepstakes account can be programmed to track both cash awards and material awards.

It is envisioned that if cash awards are given, the operator of the sweepstakes may elect to instantaneously credit the winner's financial institution account, or if the ATM is being utilized, to immediately deliver the cash prize to the user of the ATM. If the award is not given immediately at the ATM, the transaction receipt is printed to indicate the award to the user.

When the game apparatus is used in conjunction with a network system, it is possible to arrange the components such that each financial institution is in control of its own separate sweepstakes-type game. It is also envisioned that a network-wide sweepstakes-type game could be conducted.

In areas where lottery games are permitted, the apparatus is designed to be utilized as a lottery machine. The components are substantially similar, although a user would be required to pay consideration for the chance to enter the lottery sweepstakes. Preferably, a separate function key would be provided on the ATM or POS terminal whereby the user could designate an amount of money to be withdrawn from the user's financial institution accound and applied toward the lottery. This separate sweepstakes key could also be used on the standard sweepstakes-type game to increase user awareness. The sweepstakes computer is then programmed to accommodate either an instantaneous lottery determination or to enter the user's account number or other user indicia into a longer term lottery, as is well known in the art.

An alternative participation system is provided for non-account holders to participate in the game. In certain states, the charges associated with using a debit card could be considered to constitute a lottery-type situation. In that event, an alternate non-customer access means is provided whereby the presumption of consideration is defeated, so long as no charge is made for the alternative participation means. For example, a special sweepstakes card can be produced, which allows access only to the sweepstakes processor. Alternatively, the non-customer can be allowed to participate by requesting a playing card having special game indicia thereon for game play.

The drawings constitute a part of this specification and include exemplary embodiments of the present invention and illustrate various objects and features thereof.

DETAILED DESCRIPTION OF THE INVENTION

Figure 1:
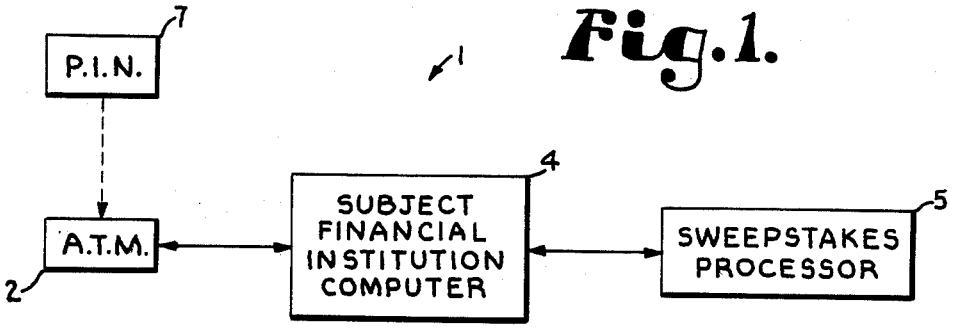
FIG. 1 is a simplified block diagram of the principal components employed for practicing an automated sweepstakes game according to the present invention, and showing an automated teller machine.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally indicates an automated sweepstakes game apparatus. An interface device, for example, an automated remote computer terminal such as an automated teller machine (ATM) 2 electronically communicates with a subject financial institution data processor or computer 4. A sweepstakes processor or computer 5 is in electronic communication with the subject financial institution computer 4 and the ATM 2. Typically, a user or player (not shown) gains access to the ATM 2 by inserting an identification card (not shown) and in addition (or instead of), by entering a personal identification number (PIN) 7.

Processor means such as the sweepstakes processor 5 reads a user indicia (not shown) such as a user's financial institution account number. The sweepstakes processor 5 generates a game indicia, such as a random prize number (not shown), and compares the user indicia and game indicia to determine whether a selected winning correlation exists between them.

The sweepstakes processor 5 relays the correlation information to the ATM and a printed receipt is given to the user, which indicates the absence or presence of the winning correlation. If a winning correlation exists, the sweepstakes processor 5 determines a prize (not shown) to be awarded a user as well as a manner of awarding the prize to the user.

Figure 2:
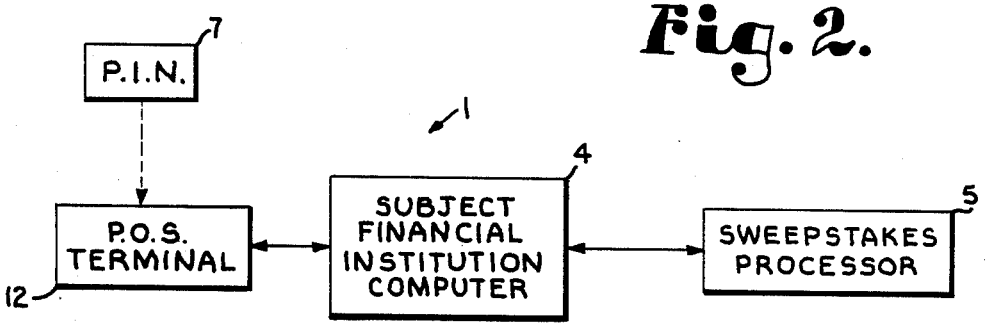
FIG. 2 is a view similar to FIG. 1 and illustrates a point-of-sale terminal in lieu of an automated teller machine.

As shown in FIG. 2, the remote computer terminal may be what is commonly known as a point-of-sale (POS) terminal 12 of the type located in a retail establishment for direct debiting of a user's financial institution account. The ATM 2 and POS terminal 12 are analogous machines, although not interchangeable. The functions of these machines are well known in the art and they will be discussed together, except where significant differences between them affect the present invention. Thus, in FIGS. 3 through 6, the POS terminal 12 could be substituted for the ATM 2. Furthermore, it is noted that a plurality of such ATM's 2 and POS terminals 12 are generally associated with a subject financial institution computer 4.

Typically, the user is provided a debit card (not shown) having a magnetically encoded stripe thereon. The debit card is adapted to be inserted into the ATM 2 and identifies the user to the subject financial institution computer 4. The PIN 7 is also used as an identification means for further validating the user's access to the subject financial computer 4. The user has an account number with the subject financial institution 4 that is specific to the user, and preferably comprises the user indicia for the present invention.

It is envisioned that the type of card known as a bank credit card could be used in lieu of the debit card, with no effect on the present invention. Further, the user indicia, in addition to comprising the user's financial institution account number (such as a checking account number), the user indicia could take the form of a number specifically assigned to the debit or credit card. It is also envisioned that the user indicia can comprise the transaction number or other number that identifies the user sufficiently to properly credit the user should he or she win the sweepstakes.

The user indicia, such as the financial institution account number, typically comprises approximately 10 digits, although the identifier can comprise alphanumeric characters. In any event, the sweepstakes processor 5 generates the game indicia such that the game indicia generally corresponds to the format of the user indicia. That is, if the user indicia comprises an account number having ten digits, the game indicia generated by the sweepstakes processor 5 would typically have ten digits.

Figure 3:
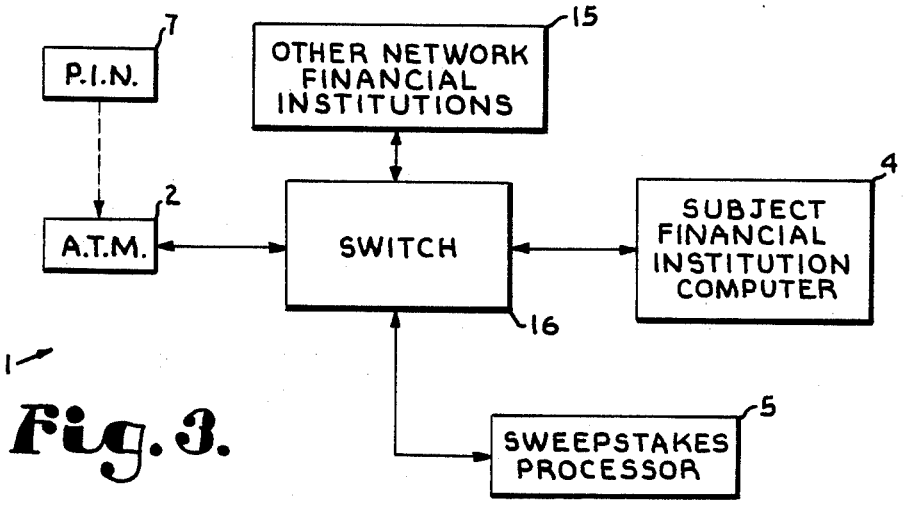
FIG. 3 is a simplified block diagram of the principal components of the automated sweepstakes game further showing a network system.
Figure 4:
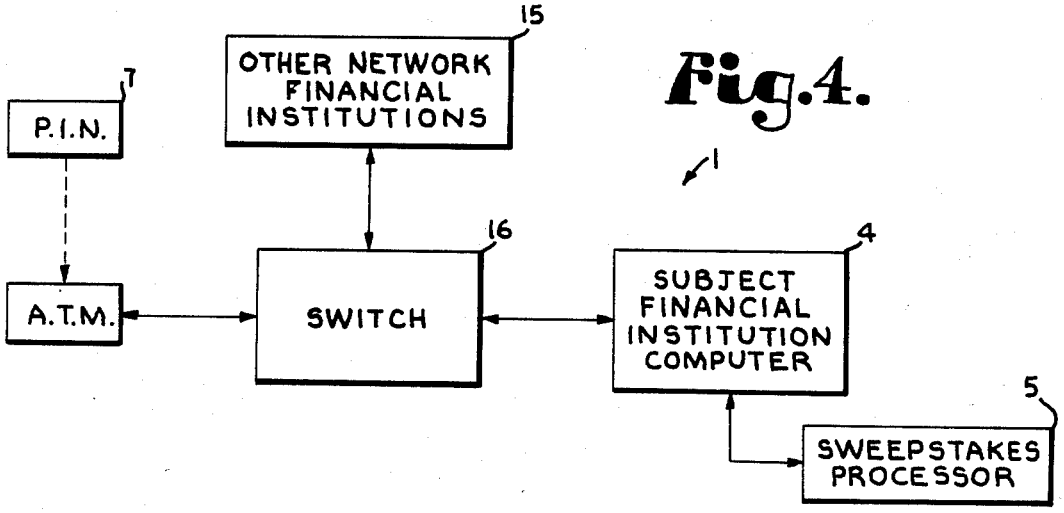
FIG. 4 is a view similar to FIG. 3 showing a first alternative arrangement of the principal components and network system.

FIGS. 3 through 6 disclose alternative configurations of the present invention, which configurations include a network of financial institutions 15 and a transmission facilities device, such as a switch 16. As illustrated in FIG. 3, the switch 16 receives an electronic communication from the ATM 2 and routes the financial institution instructions to the subject financial institution computer 4. The sweepstakes information, i.e. the user indicia, is routed to the sweepstakes processor 5 for comparison to a game indicia. As illustrated in FIG. 4, the financial institution information and the user indicia are routed to the subject financial instition computer 4. The user indicia is then routed to the sweepstakes computer 5 for further activity.

Upon completion of the data processing associated with the present invention, the information is relayed back to the switch 16. The results are routed by the switch 16 to the ATM 2 and the subject financial institution 4 for notification of the user, as seen in FIG. 3. As illustrated in FIG. 4, the results are first routed to the subject financial institution 4 and subsequently to the switch 16 for routing to the ATM 2.

Figure 5:
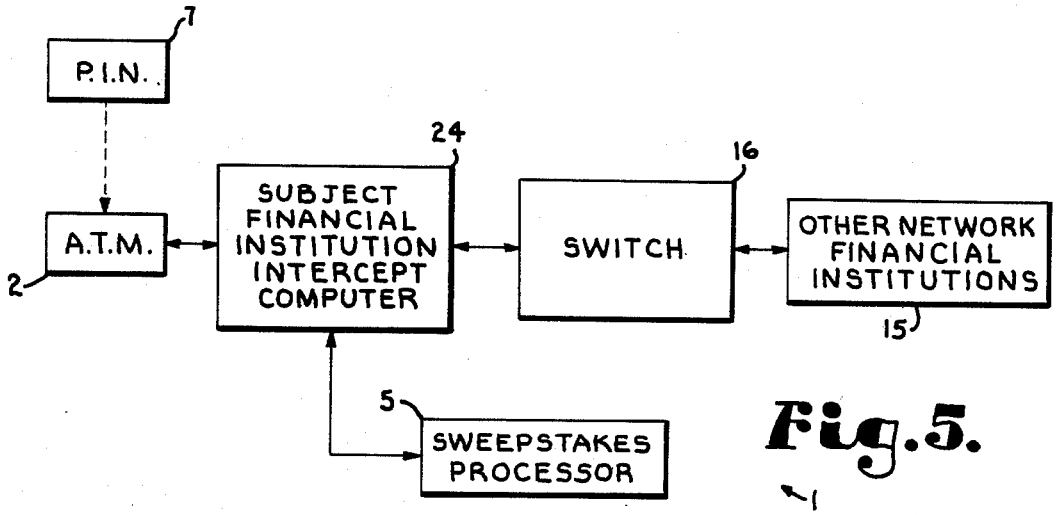
FIG. 5 is a view similar to FIG. 3 showing a second alternative arrangement of the principal components and network system.
Figure 6:
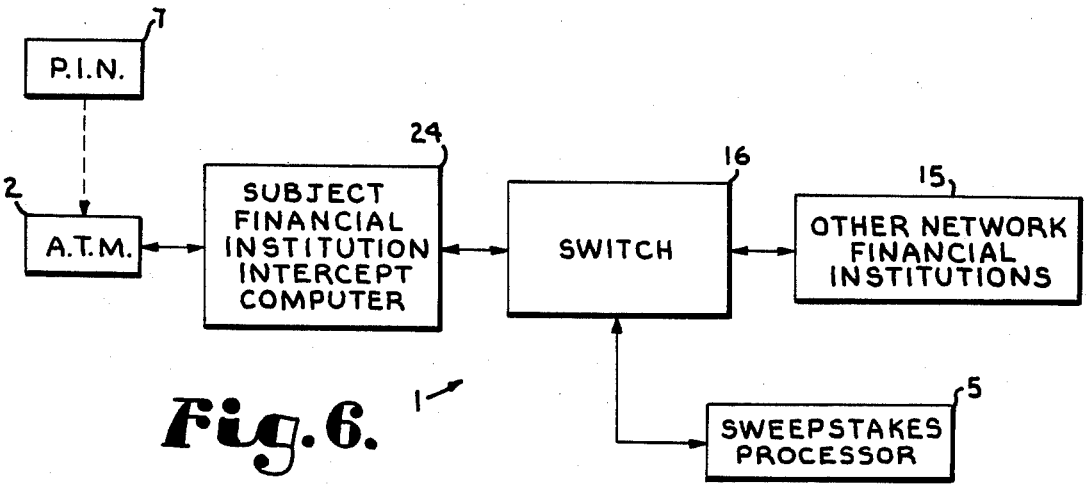
FIG. 6 is a view similar to FIG. 3 showing a third alternative arrangement of the principal components and network system.

As shown in FIGS. 5 and 6, the subject financial institution may place what is commonly known as an intercept computer 24 between the ATMs 2 associated with the financial institution and the switch 16. This positioning of the intercept computer 24 is commonly known as "operating in front of the switch38 , whereas the configurations disclosed in FIGS. 3 and 4 are known as operating by "behind the switch". The intercept computer 24 "intercepts" communications from its associated ATMs 2 which are specific to the subject financial institution, while routing communications related to other network financial institutions 15 through the switch 16.

As shown in FIG. 5, the sweepstakes processor 5 is in direct communication with the intercept computer 24 and receives the user indicia information from the ATM 2 through the intercept computer 24 without routing to the switch 16.

As illustrated in FIG. 6, the sweepstakes processor 5 is in communication with the switch 16. Accordingly, user indicia relating to a customer of the subject financial institution is routed through the intercept computer 24 and switch 16 to the sweepstakes processor 5 and back again.

It is envisioned that the present invention can take a plurality of different configurations. As discussed in the Background of the Invention, the number of institutions comprising the network financial institutions 15 is very large. At present, network systems comprising in excess of 400 financial institution members are known, which together utilize in excess of a thousand automated teller machines.

The sweepstakes processor 5 as illustrated in FIGS. 3 through 6 can accommodate a number of different sweepstake alternatives. For example, the sweepstakes processor 5 can be adapted to accommodate an individual sweepstakes configuration for the subject financial institution alone. Alternatively, the sweepstakes processor 5 can be adapted to allow any user of any of the ATMs 2 in communication with the network of financial institutions 15 to participate in a single collective sweepstakes. It is further envisioned that a sweepstakes processor 5 could accommodate a plurality of individual financial institution sweepstakes.

Figure 7:
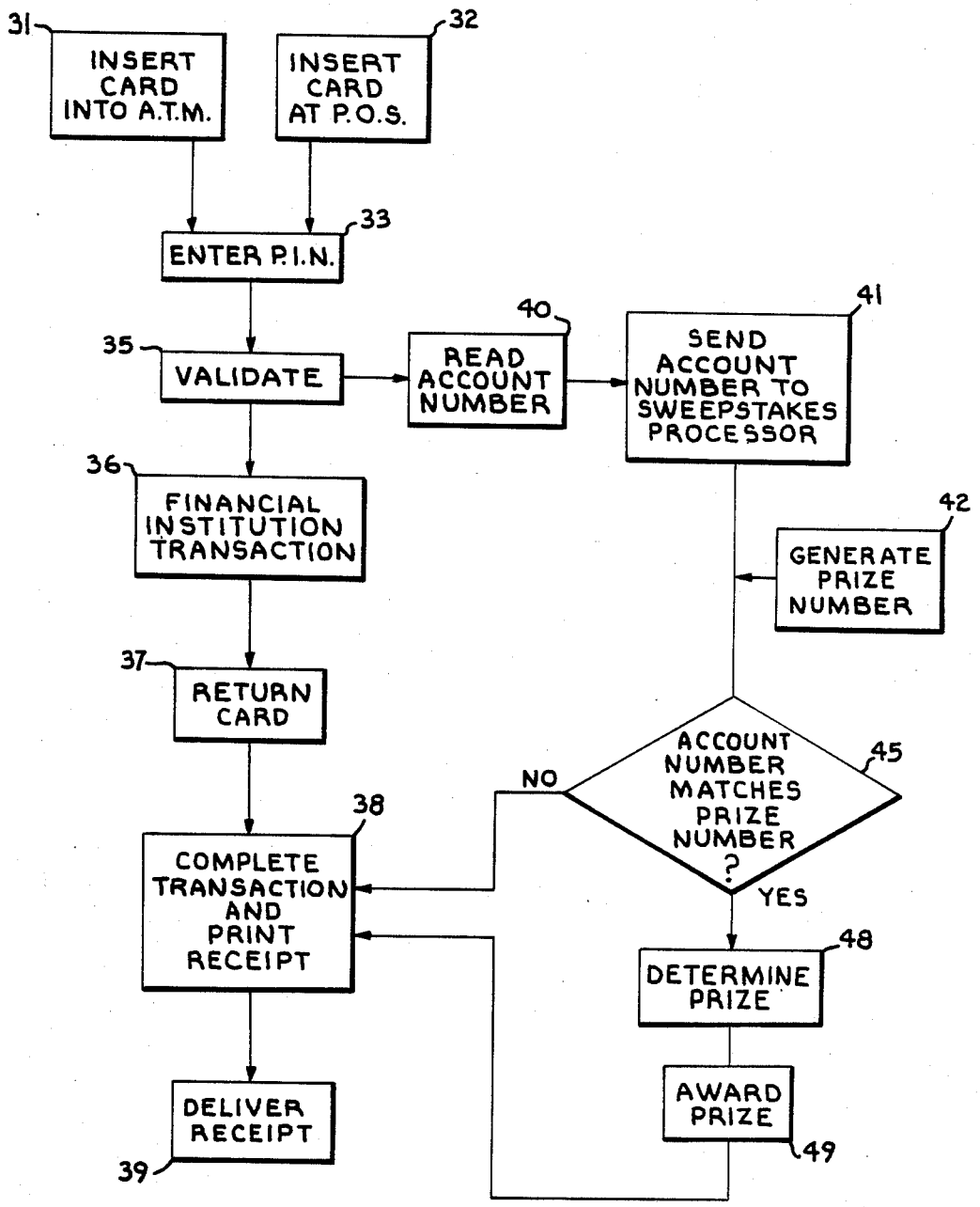
FIG. 7 is a flow chart representing the principal steps employed in practicing the automated sweepstakes game.

A preferred method of playing the sweepstakes-type game is disclosed in the flow chart of FIG. 7. Step 31 requires the insertion of an identification card, such as the previously described debit card into an ATM 2. Alternatively, the user may insert the debit card or the like into a POS terminal 12, as shown at step 32. In either event, the debit card begins the activation process and identifies the proposed user to the system. At step 33, the financial institution computer requires that the PIN 7 be entered on a keyboard (not shown) of the ATM 2 or POS terminal 12. The financial institution computer receives the information directly, or through the switch 16, as the case may be, and validates the PIN 7, provided the PIN 7 is in fact valid, as shown at step 35. Once validated, the user has access to his financial institution account and proceeds to conduct his financial institution transactions at step 36. As the user transacts his affairs with the financial institution at step 36, the sweepstakes computer reads the user's account number at step 40.

When the user has completed his transactions with the financial institution, at step 37 the card is returned to the user. At step 38, the financial transactions are completed (such as the delivery of withdrawn money) and the printing of a receipt. The receipt is delivered to the user at step 39.

The account number is sent to the sweepstakes computer at step 41. The sweepstakes computer 5 generates, or has previously generated, a prize number or numbers as shown at step 42. The account number is compared to the prize number at step 45. The numbers are compared to determine whether a predetermined winning correlation exists between the numbers, that is whether they match. If no match exists, the game branches to step 38, and the negative results are printed on a receipt which is delivered to the user at step 39.

If the account and prize numbers match at step 45, the game branches to step 48, which determines the prize to be awarded to the user. The manner of awarding the prizes is determined at step 49. Steps 48 and 49 are discussed in greater detail below. From step 49, the game is directed to step 38 where the recept is printed with the winning information, including the prize and manner of awarding same, and the receipt is delivered at step 39.

It is envisioned that numerous variations of the playing game method can be accommodated by the present invention. For example, the user indicia can be any appropriate number that is specific to the user, and it is not requires that the user be a customer of the financial institution. In order to accommodate certain existing laws concerning lotteries, it is possible that non-customers would be allowed to enter the game.

The prize number generated at step 42 can be generated randomly prior to step 40, such that winning prize number is deteremined perodically, as at the start of a business day or week. Alternatively, the prize number can be determined each time the game is played.

When a switch 16 is employed, with a collective sweepstakes among the network of financial institutions, a plurality of winning prize numbers can be generated and stored in the sweepstakes computer 5 to ensure that the prizes are distributed inan equitable manner. It is also envisioned that the prize to be-awarded can be assigned to a pre-selected prize number, thus reducing the amount of computer time involved with each playing of the game.

The sweepstakes processor 5 has a prize account which records prizes as they are awarded and ensures that each prize is awarded only once. If the prize is to be cash, the prize account must have a cash balance therein which can be depleted as the prizes are awarded.

In awarding the cash prizes, the cash may be given out from the ATM at step 38, or simply credited to the user's financial institution account for later withdrawal. In the event the prize is a material good or service, an appropriate manner of awarding same is determined at step 49, such as instructing the user to go to his or her financial institution to receive the prize. The game may be played such that each participant receives some sort of prize, such as a discount coupon for use at a local store.

In addition to notifying the user of the results of the sweepstakes by means of a printed receipt, it is also envisioned that the ATM 2 can be programmed to visually or vocally notify the user. That is, a special subroutine program could be provided to graphically demontrate the results on the ATM display screen, or to program a voice transmitter to so notify the user.

Present federal income tax laws require that a federal income tax withholding be effected on sweepstakes or gambling winnings in excess of $600. Thus, the sweepstakes processor 5 can be programmed to calculate and deduct the amount of such withholdings before awarding a cash prize.

It is to be understood that while certain forms of the present invention have been illustrated and described herein, it is not to be limited to the specific forms or arrangement of parts described and shown.

What is claimed and desired to be secured by Letters Patent is as follows:

1. Apparatus for participation of a user in a sweepstakes-type game, said apparatus comprising:

(a) an automated teller machine for communicating with the user wherein said automated teller machine is of the type used by a financial services-type institution;

(b) user identification means for providing user access to said automated teller machine;

(c) means generating user indicia specific to the user; said user indicia being passively generated without input from said user once said user has obtained access to said automated teller machine;

(d) means generating game indicia; and (e) processor means communicating with said automated teller machine, receiving said user indicia and receiving said game indicia; said processor means being adapted to compare said user indicia to said game indicia and determine whether a selected winning correlation exists between same, said processor means completing the comparison of said user game indicia generally contemporaneously with the user effecting an unrelated transaction by means of said automated teller machine, whereby there is no appreciable extra time required to complete said game in addition to said unrelated transaction.

2. The apparatus as set forth in claim 1 wherein:

(a) said game indicia is randomly generated by said processor means.

3. The apparatus as set forth in claim 1 further including:

(a) means for notifying said user of one of the existence and non-existence of the winning correlation.

4. Apparatus for playing a sweepstaketype game by a user, said apparatus comprising:

(a) a plurality of remote computer terminals; each of said computer terminals being an electronic communication with a financial institution data processing machine; each of said computer terminals being one of an automated teller machine or a point-of-sale terminal wherein said automated teller machine and point-of-sale terminal are of the type used by a financial services-type institution;

(b) a user identification card having means for identifying a financial account associated with a user at said financial institution; said identification card being adapted to be inserted into a selected one of said remote computer terminals; each of said remote computer terminals being adapted to allow said user to access electronically the financial institution account of said user;

(c) a personal identification number being associated with said user identification card and specific thereto; said personal identification number being adapted to validate user access to the financial account associated with said identification card;

(d) a sweepstakes data processor having means for passively reading an account number associated with said user's financial account without input from the user and means for generating a random number and comparing said account number to said random number while the user effects a transaction at said remote computer terminal, said compraing of said account number and said random number being effected to determine whether said account number and random number match, whereby there is no appreciable additional time required to complete said game in addition to said transaction;

(e) said sweepstakes data processor including means for determining a prize to be awarded to the user of an account number determined to match said random number.

5. Apparatus for participation of a user in a sweepstakes-type game, said apparatus comprising:

(a) a network of data processing machine, each of said data processing machines adapted to be associated with said financial institution;

(b) a transmission facilities device for providing data processing communication among said data processing machines;

(c) a plurality of remote interface devices; wherein said interface devices are of the type used by a financial services-type institution; each of said interface devices being in data processing communication with a selected financial institution data processing machine through said transmission facilities device;

(d) user identification means for providing user access to a selected one of said interface devices;

(e) means passively generating user indicia adapted to be specific to a user, said user indicia being generated without active input from the user once the user has obtained access to said interface device;

(f) means generating game indicia; and (g) process mans reading said game indicia and reading said user indicia from said interface device, compraing said user indicia to said game indicia, and determining whether a selected winning correlation exists therebetween.

6. The apparatus as set forth in claim 5 wherein said remote interface device is an automated teller machine.

7. The apparatus as set forth in claim 5 wherein said remote interface device is a point-of-sale terminal.

8. Apparatus for participation of a user in a sweepstakes-type game, said apparatus comprising:

(a) a network of data processing machines, each of said data processing machines adapted to be associated with a selected financial institution;

(b) a transmission facilities device for providing data processing communication among said data processing machines;

(c) a plurality of remote comptuer terminals; wherein said computer terminals are of the type used by a financial services-type institution; each of said computer terminals being in data processing communication with a selected financial institution data processing machine through said transmission facilities device;

(d) a plurality of user identification cards having means for identifying a respective user's financial account at said user's financial institution; each of said identification cards being adapted to be inserted into a selected one of said remote computer terminals; each of said remote computer terminals and said transmission facilities device adapted to allow said user to access the financial institution account of said user;

(e) a personal identification number being associated with each of said user identification cards and specific thereto, and beinga dapted to validate user access to the financial account associated with said identification card;

(f) a sweepstakes data processor having means passively reading an account number associated with said user's financial account without active input from the user and means generating a random number and comparing said account number to said random number and determining whether said account number and random number match;

(g) said sweepstakes data processor including means for determining a prize to be awarded to the user of an account number determined to match said random number (h) means for awarding said prize to said user of said account number determined to match said random number; and (i) recording means for notifying said user of one of the occurrence and non-occurrence of a correlative match between said account number and random number and of one of the associated awarding and non-awarding of a prize.

9. The apparatus as set forht in claim 8 further including:

(a) means for calculating an amount of a cash prize to be deducted from said prize for federal withholding taxes; and (b) means for deducting said amount of said prize to be withheld for federal withholding taxes from said cash prize amount.

10. A method of playing a sweepstakes-type game including the steps of:

(a) entering a user identifier into a computerized interface device; said interface device being one of an automated teller machine or a point-of-sale terminal wherein said automated teller machine and said point-of-sale terminal are of the type used by a financial services-type institution;

(b) accessing a financial account at a financial institution electronically through the interface device uponentry of said user identifier;

(c) passively assigning user indicia specific to said user without prompting from said user (d) selecting a random game indicia;

(e) reading said user indicia and said game indicia;

(f) camparing said user indicia to said game indicia;

(g) determining whether a winning correlation exists between said game indicia and said user indicia;

(h) awarding a selected prize to said user upon determining that said selected winning correlation exists; and (i) notifying said user of whether a selected winning correlation exists at generally the same time that said user completes an unrelated transaction with the financial institution.

11. A method of participating in a sweepstakes-type game comprising the steps of:

(a) providing a network of data processing machines associated with selected financial institutions;

(b) providing means for electronic communication among said data processing machines and between said data processing machines and said selected financial institutions;

(c) providing a plurality of remote computer terminals in electronic communication with said network of data processing machines wherein said computer terminals are of the type used by a financial services-type institution;

(d) assigning an account number to said financial institution account;

(e) accessing a selected financial institution account through a selected remote computer terminal, said communication means and a data processor specific to a financial institution associated with said financial institution account;

(f) relaying said account number to a sweepstakes processor means without active input from a user of a selected remote computer terminal;

(g) generating a random game number;

(h) comparing said account number to said game number to determine whether said account number matches said game number;

(i) determining a prize to be associated with said account number upon matching of said account number to said game number;

(j) awarding said prize to said matching account number in a preselected manner; and (k) notifying said user of one of the occurence and nonoccurence of matching said account number and said game number and determining and awarding of a prize, with the user being so notified at a time generally contemporaneous with the completion of unrelated transactions by the user.

12. Apparatus for participation of a user in a sweepstakes-type game, said apparatus comprising:

(a) a point-of-sale terminal for communicating with the user wherein said point-of-sale terminal is of the type used by a financial services-type institution;

(b) user identification means for providing user access to said point-of-sale terminal;l (c) means generating user indicia adapted to be specific to the user; said user indicia being passively generated without input from said user once said user has obtained access to said point-of-sale terminal;

(d) means generating game indicia; and (e) processor means for communicating with said point-of-sale terminal, receiving said user indicia and receiving said game indicia; said processor means being adapted to compare said user indicia to said game indicia and determine whether a selected winning correlation exists between same, said processor means completing the comparison of said user game indicia generally contemporaneously with the user effecting unrelated transactions by means of said point-of-sale terminal.

13. Apparatus for playing a game bya user, said apparatus comprising:

(a) a plurality of remote computer terminals; each of said computer terminals being in electronic communication with a financial institution data processing machine; each of said computer terminals being one of an automated teller machine or a point-of-sale terminal wherein said automated teller machine and said point-of-sale terminal are of the type used by a financial service-type institution;

(b) user identification means for providing user access to said remote computer terminal;

(c) said remote computer terminal having means for allowing the user to designate an amount of money to be withdrawn from the user's financial account and transferred to an account associated with a lottery-type game;

(d) a data processor having means for reading an account number associated with said user's financial account to effect the transfer of funds form said user's financial account to said lottery accoutn; and, (e) said data processor having means passively generating user indicia for participation in the lottery-type game without further input from said user, and determining whether said user indicia matches with lottery indicia to result in a winning correlation therebetween.

14. A method of playing a lottery-type game including the steps of:

(a) entering a user identifier into a computerized interface device; said interface device being one of an automated teller machine or a point-of-sale terminal wherein said automated teller machine and said point-of-sale terminal are of the type used by a financial services-type institution;

(b) accessing a user's financial account at a financial institution electronically through said interface device upon entry of said user identifier;

(c) designating an amount of money to be transferred from said user's financial account to a lottery account associated with a lottery-type game;

(d) assigning user indicia specific to said user for purposes of participation in said lottery-type game with no active involvement by said user in the assignment of said user indicia;

(e) operating said lottery-type game in a substantially instantaneous manner by comparing said user indicia to game indicia associated with said lottery-type game;

(f) determining whether a winning correlation exists between said game indicia and said user indicia by comparison of said game indicia and said user indicia; completing the comparison of said user game indicia generally contemporaneously with the user effecting an unrelated transaction by means of said computerized interface device, whereby there is no appreciable extra time required to complete said game in addition to said unrelated transaction; and (g) providing means for notifying said user of the existence or absence of a winning correlation between said game indicia and said user indicia.

15. Apparatus for participation of a user in a sweepstakestype game, said apparatus comprising:

(a) a remote interface device for communicating with the user, wherein said remote interface device is generally of the type used by a financial services-type institution and is used to effect transactions with said institution;

(b) user identification means for providing user access to said interfce device;

(c) user indicia specific to the user;

(d) game indicia;

(e) sweepstakes processor means communicating with said interface device, said processor means including means automatically selecting said user indicia following said user obtaining access to said interface device;

(f) said processor means automatically selecting said game indicia following said user obtaining access to said interface device;

(g) means comparing said user indicia to said game indicia and automatically determining whether a selected winning correlation exists betwen said user indicia and said game indicia; and (h) whereby said game is played without input by the user upon the user obtaining access to said interface device.

16. Apparatus for playing a game by a user, said apparatus comprising:

(a) a plurality of remote computer terminals; each of said computer terminals being in electronic communication with a financial institution data processing machine; each of said computer terminals being one of an automated teller machine or a point-of-sale terminal of the type used by financial services-type institutions;

(b) user identification means; said remote computer terminals being responsive to said user identification means to provide user access to said remote computer terminals;

(c) said remote computer terminals each having means allowing the user to designate an amount of money to be withdrawn from a financial account associated with said user and transferred to an account associated with a lottery-type game;

(d) a data processor having means for reading an account number associated with said user's financial account to effect the transfer of funds from said user's financial account to said lottery-type game account;

(e) means associated with said data processor for generating user indicia for participation in the lottery-type game; said means for generating user indicia including means for allowing the user to select one or more lottery numbers for participation in the lottery-type game; and (f) means associated with said data processor for transmitting said user indicia to processing means associated with the lottery-type game, such that user indicia is entered into said lottery-type game.

17. The apparatus as set forth in claim 16 wherein:

(a) said data processor records said user indicia and the amount of money transferred from the user's financial account to said account associated with the lottery-type game; and (b) said data processor records the amount of money transferred and the user indicia on the transaction receipt issued to the user.

* * * * *